United States Patent [19]

Tocci

[11] 3,942,693

[45] Mar. 9, 1976

[54] WRIST PURSE WITH ELASTIC SECURING MEANS

[75] Inventor: Florindo Tocci, Nashua, N.H.

[73] Assignee: Raymond Lee Organization Inc.

[22] Filed: Nov. 20, 1974

[21] Appl. No.: 525,297

[52] U.S. Cl. ..... 224/28 B; 150/47

[51] Int. Cl.[2] ..... A45C 1/00

[58] Field of Search .... 224/28 R, 28 B, 28 C, 28 D, 224/28 F, 25 R, 26 R, 26 B, 26 W, 5 R, 5 A, 5 B, 5 H, 4 A, 2 D; 150/47

[56] References Cited

UNITED STATES PATENTS

| | | | |
|---|---|---|---|
| 75,458 | 3/1868 | Pratt | 224/28 B |
| 1,287,875 | 12/1918 | Careless | 224/26 F |

FOREIGN PATENTS OR APPLICATIONS

| | | | |
|---|---|---|---|
| 542,202 | 12/1941 | United Kingdom | 150/47 |

*Primary Examiner*—Robert J. Spar
*Assistant Examiner*—Jerold M. Forsberg

[57] ABSTRACT

A device employing a wrist purse slidably secured to the arm of a wearer, the purse being normally hidden under the sleeve of a garment worn by the wearer. Means secured removably to the arm under the sleeve and secured to the purse holds the purse in hidden position except when the purse is pulled along the arm and the wrist and is held momentarily exposed for use. As soon as the purse is released, it is retracted into hidden position.

2 Claims, 4 Drawing Figures

FIG. 1
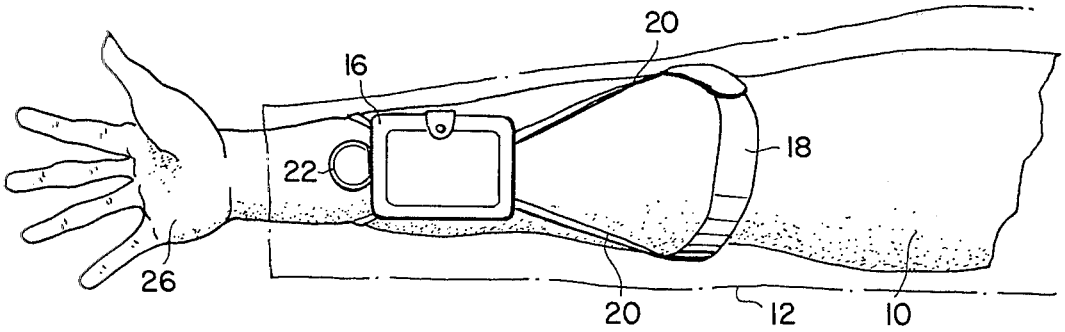
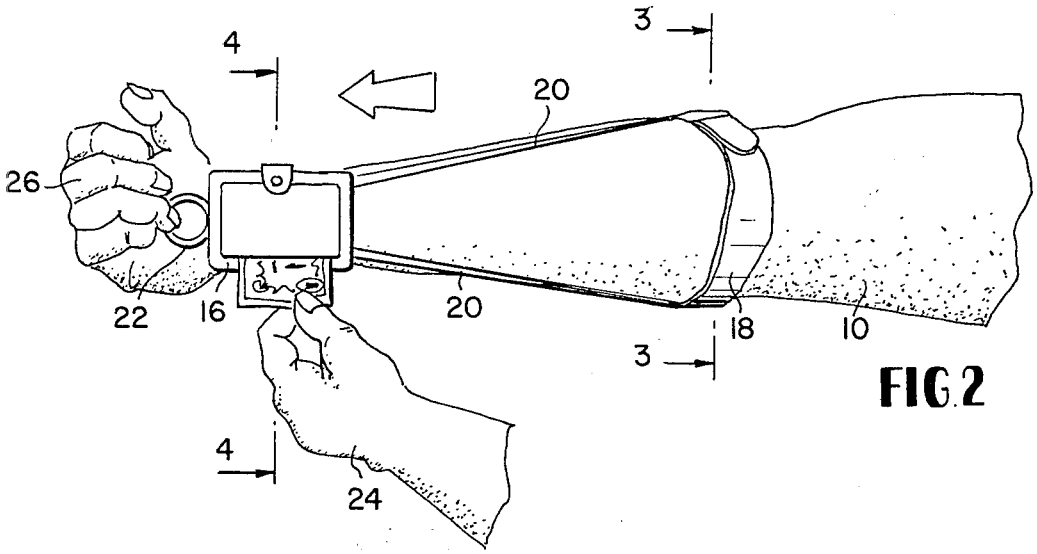
FIG. 2
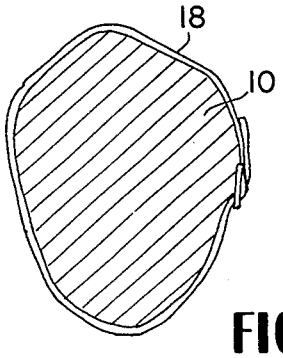
FIG. 3
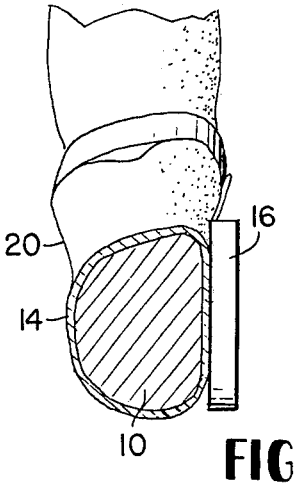
FIG. 4

WRIST PURSE WITH ELASTIC SECURING MEANS

BACKGROUND OF THE INVENTION

In order to protect purses containing money and other valuables from being stolen by pickpockets, purse snatchers and other criminals, it is known to conceal purses when not in use. For example, U.S. Pat. No. 1,313,229 discloses a secret pocket supported against a leg of a wearer by means which also serve as a hose supporter and is suspended from a corset. U.S. Pat. No. 1,416,238 shows a purse supported by straps which are secured to a body encircling strap. These and other patents do provide protection, but the user must rearrange clothing both to provide access to the purse and thereafter to conceal same. This invention not only provides purse concealment but also enables the user to obtain access to the purse and then conceal same without rearranging clothing. Moreover, access to the purse is performed much more easily and quickly and the purse is concealed quickly, easily and automatically.

SUMMARY OF THE INVENTION

In accordance with the principles of this invention, a wrist purse is slidably disposed on and secured to the arm of a user, the purse being normally hidden under the sleeve of the garment worn by the user but being slid along the wrist into exposed position for insertion or removal of money when the purse is pulled into this position and held thereat by the user.

Elastic means secured removably to the arm under the sleeve and also secured to the purse applies a retraction force to the purse which causes the purse to be automatically retracted into hidden position as soon as the purse is released from exposed position.

BRIEF DESCRIPTION OF THE DRAWINGS

In the drawings:

FIG. 1 is a side view of the invention in use showing the purse in hidden position;

FIG. 2 is a view similar to FIG. 1 but showing the purse in exposed position;

FIG. 3 is a view taken along line 3—3 in FIG. 2; and

FIG. 4 is a view taken along line 4—4 in FIG. 2.

DETAILED DESCRIPTION OF PREFERRED EMBODIMENTS

Referring now to FIGS. 1–4, a user has arm 10 extending through long sleeve 12 of a suitable garment. A strap 14 encircles the arm and is secured to and supports a wrist purse 16 having a normally closed pocket into which money can be inserted and out of which money can be removed. The strap 14 can fit loosely so that it and purse are slidable together along the arm. The strap can be secured fixedly at one end to the purse and can be detachably secured thereto at the other end by snaps or the like. Another strap 18 can be removably wrapped about the arm between wrist and elbow in a non-slidable manner. Oppositely disposed snaps or other means such as Velcro type fasteners or buckle means can be used to secure opposite ends of strap 18 together.

Three spaced elastic straps 20 extend transversely along the arm, being secured at one set of ends to strap 18 and at the other set of ends to the strap 14 and purse 16. The opposite end of the purse carries pull ring 22. Ring 22 is also normally concealed.

When the device is in position on the arm, straps 20 normally hold the purse in concealed position within the sleeve 12.

To use the purse, the user pulls the purse along the wrist against the pull of the straps 20, extending the straps until the purse is exposed, using the hand 24 of the arm which does not carry the purse. Once the purse is in position, ring 22 is grasped by the other hand 26 to hold the purse for use. Once ring 22 is released, the straps 18 pull the purse toward strap 18 until the purse slides into the sleeve and is again concealed from view.

While my invention has been described with particular reference to the drawings, such is not to be considered as limiting its actual scope.

Having thus described this invention, what is asserted and claimed as new is:

1. A device adapted for use by an individual wearing a garment with a sleeve through which an arm extends, said device comprising:

a first strap secured to the arm and extending therearound in non slidable fixed position within the sleeve near the elbow;

a wrist purse having a pocket for holding valuables and having two opposite ends;

a second strap secured at each end to a corresponding one end of the purse, said purse and said second strap forming a loop which is disposed on the wrist and is slidable therealong; and a plurality of elastic straps, each of which is secured at one end to the first strap and at the other end to said loop, said elastic straps extending longitudinally along the arm between the first strap and the loop, whereby the purse has a normal retracted position hidden within the sleeve and is capable of being pulled outside the sleeve against the tension of the elastic straps for access by the wearer.

2. The device of claim 1 wherein the purse has a pull ring secured thereto.

* * * * *